US005130359A

United States Patent [19]

Ohsumi et al.

[11] Patent Number: 5,130,359

[45] Date of Patent: Jul. 14, 1992

[54] VISCOSITY INDEX IMPROVER AND METHOD FOR PRODUCING THE SAME

[75] Inventors: Tatsuya Ohsumi; Shigeyuki Yoshida, both of Kyoto; Yoshio Kano, Uji; Kouzou Sakai, Omihachiman, all of Japan

[73] Assignee: Sanyo Chemical Industries, Ltd., Kyoto, Japan

[21] Appl. No.: 546,225

[22] Filed: Jun. 29, 1990

[30] Foreign Application Priority Data

Jul. 4, 1989 [JP] Japan ..... 1-173251
Aug. 8, 1989 [JP] Japan ..... 1-205090

[51] Int. Cl.[5] ..... C08L 23/16

[52] U.S. Cl. ..... 524/145; 524/297; 524/308; 524/314; 524/378; 524/504; 252/51.5 A; 252/51.5 R; 252/48.6; 252/57 R; 252/52 A; 252/47.5; 252/48.2

[58] Field of Search ..... 524/504, 297, 308, 314, 524/378, 145, 501; 525/71; 252/51.5 A, 51.5 R, 48.6, 52 R, 52 A, 47.5, 48.2

[56] References Cited

U.S. PATENT DOCUMENTS

| | | | |
|---|---|---|---|
| 3,264,234 | 8/1966 | Osmond et al. | 525/77 |
| 3,284,380 | 11/1966 | Davis | 260/8 |
| 3,514,500 | 5/1970 | Osmond et al. | 525/301 X |
| 4,089,794 | 5/1978 | Engel | 252/51.5 A |
| 4,290,925 | 9/1981 | Pennewiss et al. | 252/56 S |
| 4,402,841 | 9/1983 | Schieman | 252/46.6 |
| 4,622,358 | 11/1986 | Pennewiss et al. | 524/297 |
| 4,665,121 | 5/1987 | Pennewiss et al. | 524/457 |
| 4,677,151 | 6/1987 | Pennewiss et al. | 524/501 |
| 4,780,228 | 10/1988 | Gardiner | 252/51 |
| 5,026,496 | 6/1991 | Takigawa et al. | 252/56 R |

OTHER PUBLICATIONS

P. G. Cook, Latex, Reinhold, New York, 1956, pp. 49–50.

*Primary Examiner*—Joseph L. Schofer
*Assistant Examiner*—M. Nagumo
*Attorney, Agent, or Firm*—Armstrong, Nikaido, Marmelstein, Kubovick & Murray

[57] ABSTRACT

Disclosed is a viscosity index improver in the form of a high-concentration non-aqueous dispersion of a low-viscosity olefinic polymer and a method of preparing the same. The improver comprises (1) an olefinic polymer, (2) a compound of (i) or (ii), (i) being a compound having at least one segment comprising A and B wherein A is a residue of a compound substantially composed of a hydrocarbon having a weight average molecular weight of 500 to 500,000 and having hydroxyl and/or carboxyl and/or carbonyl and/or amino and/or dithiocarboxyl group(s) and B is a residue of a compound having carboxyl and/or hydroxyl and/or isocyanate and/or amino and/or ketomine group(s), said A and B being bonded through at least one linkage selected from ester linkage, thioester linkage, urethane linkage, urea linkage, amide linkage, imide linkage and ether linkage, and (ii) being a reaction product of AA and BB wherein AA is an olefinic polymer having a weight average molecular weight of 500 to 500,000 and added with ethylenic unsaturated dicarboxylic acid(s) and BB is a compound having at least one group selected from mercapto group, amino group, ketimine group, hydroxy group and isocyanate group, said AA and BB being bonded through at least one linkage selected from thioester linkage, amide linkage, imide linkage and ester linkage, and (3) a medium which does not substantially dissolve or which scarcely dissolves the said olefinic polymer.

26 Claims, No Drawings

VISCOSITY INDEX IMPROVER AND METHOD FOR PRODUCING THE SAME

FIELD OF THE INVENTION

The present invention relates to a viscosity index improver and a method for producing the same.

BACKGROUND OF THE INVENTION

Hitherto, an olefinic polymer-based viscosity index improver has been widely employed in engine oil due to its excellent thickening effect. The viscosity index improver of this type is distributed as a commercial product in the form of a solution comprising approximately 10 to 20% of an olefinic polymer and approximately 90 to 80% of a mineral oil. If the proportion of the olefinic polymer component is increased above this range, the viscosity of the product is too large, causing handling problems. As such, the product is not of practical use. Accordingly, a viscosity index improver product which contains an olefinic polymer in a high concentration but which has a low viscosity is needed. In order to satisfy this need, some methods have been proposed. For instance, Japanese Patent Kokai No. 171417/83 discloses a method of incorporating a graft or block copolymer of an olefinic copolymer and a (meth)acrylate into a solvent which does not substantially dissolve or which scarcely dissolves the olefinic copolymer, for use as a dispensing agent to obtain a high-concentration product. Japanese Patent Kokai No. 171418/83 discloses another method of incorporating a graft or block copolymer comprising an olefinic copolymer and vinyl monomer(s) other than (meth)acrylates into a solvent which does not substantially dissolve or which scarcely dissolves the olefinic copolymer, for use as a dispersing agent, also to obtain a high-concentration product. However, these methods of preparing the dispersing agent are troublesome since preparation of the dispersing agent to be used requires more (meth)acrylates than theoretically needed and the dispersing agent must always be used in a large amount (for example, 12% or more), except when a styrene-isoprene block copolymer is used as a dispersing agent. Such dispersing agents are, not efficient. In addition, when a styrene-isoprene copolymer is used as a dispersing agent, the product causes haze or cloudiness when dissolved in mineral oil. Such haze or cloudiness often causes problems in practical use.

Regarding methods of preparing the products, the above-mentioned Japanese Patent Kokai Nos. 171417/83 and 171418/83 discloses a method of adding a granular olefinic copolymer into a dispersing agent-containing poor solvent and emulsifying them with a particular high shearing force stirrer. However, the method does not use a standard or conventional stirrer, but rather a particular stirrer. Additionally, since a granular olefinic copolymer is required, the propylene content in the olefinic copolymer is inevitably to be approximately 30% or less or approximately 70 or more. (This is because if the propylene content is 40 to 60% the olefinic copolymer itself would be soft and therefore could hardly be shaped into granules ) Further, where the olefinic polymer is degraded or modified in a solvent solution prior to emulsification, the resulting solvent solution of the degraded or modified olefinic polymer could not be directly used. As such, the disclosed method has various unfavorable problems.

The present inventors have studied and investigated various efficient methods of high-concentration non-aqueous dispersion of low-viscosity olefinic polymers and, as a result, have achieved the present invention.

SUMMARY OF THE INVENTION

Specifically, the present invention provides a viscosity index improver which comprises:

(1) an olefinic polymer, (2) a compound (i) or (ii), (i) a compound having at least one segment comprising A and B wherein A is a residue of a compound substantially composed of a hydrocarbon having a weight average molecular weight of 500 to 500,000 and having hydroxyl and/or carboxyl and/or carbonyl and/or amino and/or dithiocarboxyl group(s) and B is a residue of a compound having carboxyl and/or hydroxyl and/or isocyanate and/or amino and/or ketimine group(s), said A and B being bonded through at least one linkage selected from ester linkage, thioester linkage, urethane linkage, urea linkage, amide linkage, imide linkage and ether linkage, (ii) a reaction product of AA and BB wherein AA is an olefinic polymer having a weight average molecular weight of 500 to 500,000 and added with ethylenic unsaturated dicarboxylic acid(s) and BB is a compound having at least one group selected from mercapto group, amino group, ketimine group, hydroxy group and isocyanate group, said AA and BB being bonded through at least one linkage selected from thioester linkage, amide linkage, imide linkage and ester linkage, and (3) a medium which does not substantially dissolve or which scarcely dissolves the said olefinic polymer; and a method for producing such a viscosity index improver.

DETAILED DESCRIPTION OF THE INVENTION

The olefinic polymers to be used in this invention as component (1) are generally polymers or copolymers of olefins such as ethylene, propylene, isobutylene, butadiene, isoprene, etc. Further, it is also possible to use copolymers comprising the said olefins and styrene, cyclopentadiene, dicyclopentadiene, ethylidenenorbornene, etc., as well as hydrogenated products of these polymers. Needless to say, various degraded products of these olefinic polymers may also be used. Generally, it is preferable to use ethylene-propylene copolymers since these copolymers are readily available.

As component (1), modified olefinic polymers containing nitrogen, oxygen and/or sulfur atom(s), for example, basic nitrogen-containing olefinic polymers are preferred, as they are effective in dispersing varnishes or sludges which will be formed during use of the improver of the invention, in addition to the viscosity index-improving effect thereof. Preferable examples of the basic nitrogen-containing olefinic polymers include those obtained by adding or graft-copolymerizing an acidic component such as maleic acid (anhydride) or (meth)acrylic acid to olefinic polymers followed by imidating or amidating the resulting addition copolymers or graft copolymers. Additionally, there are further mentioned other various polymers, such as those obtained by oxidizing or hydroperoxidizing olefinic polymers followed by reaction with polyamines; those obtained by oxidizing olefinic polymers followed by condensation with formaldehyde and polyamine by Mannich condensation; those obtained by grafting olefinic polymers with nitrogen-containing vinyl monomers (for example, N-vinyl pyrrolidone, N-vinyl thiopyrrolidone, dialkylaminoethyl (meth)acrylates, N-vinylimidazole, etc.); and those obtained by graft-adding nitrogen-containing non-vinyl compounds (for example, phenothiazines, imidazoles, thiazoles, benzothiazoles, triazoles, thiazolidines, pyrimidines, pyridines, piperidines, pyrrolidinones, oxazoles, thiomorpholines, etc.) to olefinic polymers.

Generally, the compounds containing oxygen, nitrogen and/or sulfur may be used in an amount of 0.01 to 10 parts by weight, preferably 0.5 to 6 parts by weight, per 100 parts by weight of the olefinic polymer.

The olefinic polymers for use in the invention generally have a weight average molecular weight of 500 to 500,000, but those having a weight average molecular weight of 30,000 to 300,000 are preferred in view of the viscosity index, the thickening effect and the shear stability.

Component (2) is employed to obtain a high-concentration non-aqueous dispersion of an olefinic copolymer, and functions as a dispersing agent for the olefinic copolymer component (1).

A compound having a weight average molecular weight of 500 to 500,000, having hydroxyl and/or carboxyl and/or carbonyl and/or amino and/or dithiocarboxyl group(s) and substantially having a hydrocarbon group (—A—) (hereinafter referred to as "compound (A)"), which is employed for forming the component (2)(i), acts as a dispersing agent and has at least one hydroxyl, carboxyl, carbonyl, amino and/or dithiocarboxyl group(s) in one molecule. In particular, it includes homopolymers or copolymers comprising ethylene, propylene, butadiene, isoprene, isobutylene, etc., optionally along with styrene, cyclopentadiene, dicyclopentadiene, norbornene, etc. as comonomers, the polymers or copolymers being terminated by carboxyl and/or hydroxyl and/or carbonyl and/or amino and/or dithiocarboxyl group(s). Methods of preparing such compounds are described in various literature (for example, Japanese Patent Publication No. 27432/68; "KOBUNSHI RONBUNSHU" (Japanese Journal of Polymer Science and Technology), Vol. 46, No. 4, pp. 215). In general, they are easily prepared by polymerizing olefins by living anionic polymerization whereupon, for example, carbon dioxide, oxygen, formaldehyde, ethylene oxide, propylene oxide, carbon disulfide, etc. are used as a reagent for terminating the polymerization reaction. Where carbon dioxide is used, polymers or copolymers terminated by a carboxyl group are obtained; where oxygen is used, polymers or copolymers terminated by a hydroxyl group are obtained; where formaldehyde is used, polymers or copolymers terminated by a methylol group are obtained; where ethylene oxide is used, polymers or copolymers terminated by a hydroxyethyl group are obtained; and where carbon disulfide is used, polymers or copolymers terminated by a dithiocarboxyl group are obtained. In accordance with the present invention, these compounds may be used directly (without further reaction). Additionally, those added with an alkylene oxide having 2 to 4 carbon atoms (for example, ethylene oxide, propylene oxide, etc.) generally in an amount of 10 mols or less may also be used.

Preferred examples of compounds (A) for use in the present invention are compounds having one to 3.5, more preferably one to 2.5, carboxyl and/or hydroxyl groups per molecule of the compound (A).

Compounds (A) for use in the present invention include compounds (A) themselves and condensation and/or reaction products of compounds (A) by themselves. For instance, such reaction products include condensation products of compounds (A) by themselves, such as a condensation product of a compound (A) having carboxyl group(s) and a compound (A) having hydroxyl group(s). In this case, it is necessary that both compounds are bonded through a linkage of one equivalent or less per 40 carbon atoms, preferably 150 carbon atoms, in the compound (A), for example, through an ester linkage, thioester linkage, amide linkage, imide linkage, urethane linkage, urea linkage, ether linkage, etc. Compounds (A) containing polymers formed by reacting the same or different compounds (A) with a compound having carboxyl group, hydroxyl group, isocyanate group, amino group or ketimine group (hereinafter referred to as "compound (B)").

Compounds (A) containing a polymer moiety having a composition similar to component (1), are preferred since dispersion of the component (1) is easier. Compound (A) generally has a molecular weight of 500 to 500,000, preferably 1,000 to 500,000, more preferably 10,000 to 300,000.

For forming the component (2)(i), compound (B) is also necessary. Compound (B) is one having at least one functional group in one molecule. For instance, when compound (A) is one having hydroxyl group(s), compound (B) requires a carboxyl and/or isocyanate group. When compound (A) is one having carboxyl group(s), compound (B) requires hydroxyl and/or isocyanate and/or amino and/or ketimine group(s).

Examples of compound (B) include saturated or unsaturated alcohols as compounds having one hydroxyl group, such as methyl alcohol, butyl alcohol, isoamyl alcohol, myristyl alcohol, melissyl alcohol, allyl alcohol, propargyl alcohol, cyclohexanol, benzyl alcohol, cinnamyl alcohol, furfuryl alcohol, etc., as well as compounds having two or more hydroxyl groups, such as ethylene glycol, propylene glycol, butanediol, pentanediol, 3-methylpentanediol, diethanolamine, dipropanolamine, triethanolamine, trimethylolpropane, glycerine, pentaerythritol, etc. Additionally, they further include 2-4C alkyleneoxide adducts to the said hydroxyl-having compounds and derivatives thereof. They also include 2-4C alkyleneoxide adducts to mono- or dialkylphenols (where the alkyl moiety generally has 6 to 20 carbon atoms).

Examples of carboxyl-containing compounds include those having one carboxyl group such as acetic acid, propionic acid, hexylic acid, capric acid, undecylic acid, myristic acid, eicosanic acid, oleic acid, cinnamic acid, lanolic acid, tall oil fatty acid, palm oil fatty acid, etc., as well as those having two or more carboxyl groups such as oxalic acid, succinic acid, adipic acid, azelaic acid, sebacic acid, fumaric acid, maleic acid, phthalic acid, phthalic anhydride, terephthalic acid, tricarballylic acid, benzenetricarboxylic acid, etc. They further include 2-4C alkyleneoxide adducts to the said carboxylic acid compounds or derivatives thereof.

Examples of amino group-containing compounds include aliphatic amines such as ammonia, ethylamine, butylamine, hexylamine, octylamine, nonylamine, decylamine, tridecylamine, cetylamine, dimethylamine, diisopropylamine, diamylamine, etc.; alkanolamines such as monoethanolamine, monopropanolmaine, etc.;

unsaturated aliphatic amines such as allylamine, diallylamine, etc.; alicyclic amines such as cyclohexylamine, etc.; aromatic amines such as aniline, toluidine, benzylamine, diphenylamine, naphthylamine, etc.; polyamines such as ethylenediamine, diethylenetriamine, triethylenetetramine, dialkylaminopropylamine, etc.; as well as amines derived from natural substances such as beef tallow amine, coconut amine, etc. Additionally, they further include 2-4C alkyleneoxide adducts to the said amines or derivatives thereof.

Examples of ketimine group-containing compounds include those formed by ketiminating amines such as monoethanolamine, monopropanolamine, diethylenetriamine, etc. with ketones such as acetone, methyl ethyl ketone, ethyl isobutyl ketone, etc. They also include 2-4C alkyleneoxide adducts to the said ketiminated compounds.

Examples of isocyanate group-containing compounds include those having one to three isocyanate groups such as tolylene isocyanate, diphenylmethane isocyanate, hexamethylene isocyanate, lysine isocyanate, dicyclohexylmethane isocyanate, isophorone isocyanate, xylylene isocyanate, etc. They further include adducts of these isocyanates and polyhydric alcohols or polyhydric phenols.

In accordance with the present invention, condensation and/or reaction products of compounds (B) themselves can also be used as the component for compound (B).

Component (2)(i) is obtained by condensation and/or additional reaction of the said compound (A) and compound (B). In this case, the linkage between compound (A) and compound (B) is composed of one or more of ester bond, thioester bond, urethane bond, urea bond, amide bond, imide bond and/or ether bond.

The present invention also includes employment of adducts to be obtained by adding one or more alkyleneoxides to the hydroxyl and/or carboxyl and/or amino and/or dithiocarboxyl group(s) of the compound (A), as the component (2)(i). Additionally, compounds to be obtained by directly reacting one or more compounds having two or more groups of hydroxyl and/or carboxyl and/or ketimine and/or isocyanate and/or amino groups among compounds (B) with the hydroxyland/or carboxyl and/or carbonyl and/or amino and/or dithiocarboxyl group(s) of the compound (A) also fall within the scope of the present invention; and compounds to be obtained by further adding one or more alkyleneoxides to the said compounds also fall within the same.

Among these various kinds of component (2)(i), those which have a similar molecular structure to component (3) (a medium which does not substantially dissolve or which scarcely dissolves component (1)) and/or those which have a near solubility parameter between them are basically preferred as these components may easily be dispersed. For instance, where a medium of a phthalate solvent is employed as component (3), it is desired that component (2)(i) is one having a phthalate structure in the molecule. On the other hand, where a medium of an alkylene glycol solvent is employed as component (3), it is desired that component (2)(i) has an alkylene glycol or alkylene glycol ester structure in the molecule. However, even though both components do not have similar structures, they would also be preferred provided that the difference in the solubility parameter between component (3) and the moiety B in component (2)(i) is small (generally, 1.5 or less), because of the same reason as mentioned above.

The proportion of compound (A) to compound (B) varies, depending upon the component (3) to be used, and therefore cannot be defined indiscriminately. Generally, however, the proportion of compound (A)/compound (B) is from 20/80 to 90/10 (by weight), preferably from 40/60 to 80/20.

As examples of a compound of an olefinic polymer having a weight average molecular weight of 500 to 500,000 and added with ethylenic unsaturated dicarboxylic acid(s) (hereinafter referred to as "compound (AA)"), which is employed for forming component (2)(ii) to act as a dispersing agent, there are mentioned compounds to be prepared by adding one mole or more ethylenic unsaturated dicarboxylic acid(s) to one mol of an olefinic polymer having a weight average molecular weight of 500 to 500,000.

Olefinic polymers as referred to herein include homopolymers or copolymers comprising ethylene, propylene, butadiene, isoprene, isobutylene, etc., optionally along with styrene, cyclopentadiene, dicyclopentadiene, norbornene, etc. as comonomers, as well as hydrogenated products or degraded products of the said polymers or copolymers.

Among the said olefinic polymers, preferred are those having a similar olefin composition to the component (1) to be dispersed therewith. The olefinic polymers generally have a molecular weight of 500 to 500,000, preferably 1,000 to 500,000, more preferably 10,000 to 300,000.

Ethylenic unsaturated dicarboxylic acids are employed for the purpose of introducing carboxyl groups into the olefinic polymers. The acids are compounds having ethylene bond(s) and carboxyl groups or anhydrides thereof or polar groups capable of being converted into carboxyl groups by oxidation, hydrolysis or the like. Examples of such compounds include unsaturated dicarboxylic acids such as maleic acid, itaconic acid, fumaric acid, etc.; unsaturated dicarboxylic acid derivatives such as maleic acid dichloride, fumaric acid dichloride, maleic acid monobutyl ester, maleic acid monobutylamide, chloromaleic acid, etc.; unsaturated dicarboxylic acid anhydrides such as maleic anhydride, itaconic anhydride, etc.; as well as unsaturated dicarboxylic acid anhydride derivatives such as chloromaleic anhydride, etc.

Adducts of these compounds to olefinic polymers may be prepared by methods described in various literature (for example, U.S. Pat. No. 3,236,917), for example, in the presence or absence of a free-radical initiator.

Preferred examples of compounds (AA) are compounds to be prepared by adding 1 to 200 molecules, more preferably 5 to 50 molecules, ethylenic unsaturated dicarboxylic acids to one molecule of an olefinic polymer.

"Addition" as referred to herein does not mean a so-called polymerization. In accordance with the present invention, the ethylenic unsaturated dicarboxylic acids do not form a graft polymer with the olefinic polymer but, for example, they are in the form of an adduct where one equivalent of the acid is added to one equivalent of the active hydrogen in the olefinic polymer. Specifically, the unsaturated dicarboxylic acids in the compound (AA) do not substantially form a segment where two or more molecules of themselves are bonded to each other.

For forming the component (2)(ii), a compound having at least one group selected from hydroxyl group, isocyanate group, amino group, ketimine group and mercapto group (hereinafter referred to as "compound (BB)") is necessary, and the compound has at least one functional group in one molecule.

Examples of compounds(BB) include the following compounds:

(1) Amino group-containing compounds, for example, ammonia, aliphatic amines such as ethylamine, butylamine, hexylamine, octylamine, nonylamine, decylamine, tridecylamine, cetylamine, dimethylamine, diisopropylamine, diamylamine, etc.; polyamines such as ethylenediamine, diethylenetriamine, triethylenetetramine, dialkylaminopropylamines, 1,4-diaminomethylcyclohexane, etc.; alkanolamines such as monoethanolamine, monopropanolamine, etc.; unsaturated aliphatic amines such as allylamine, diallylamine, etc.; alicyclic amines such as cyclohexylamine, etc.; aromatic amines such as aniline, toluidine, benzylamine, diphenylamine, naphthylamine, etc.; heterocyclic amines such as morpholine, imidazoline, N-aminoalkylpiperazines, etc.; amines derived from natural substances such as beef tallow amine, coconut amine, etc.; as well as 2-4C alkyleneoxide adducts to the said amines.

(2) Ketimine group-containing compounds, for example, those to be obtained by ketiminating amines such as monoethanolamine, monopropanolamine, diethylenetriamine, etc. with ketones such as acetone, methyl ethyl ketone, methyl isobutyl ketone, etc.; as well as 2-4C alkyleneoxide adducts to the said compounds.

(3) Hydroxyl group-containing compounds, for example, saturated or unsaturated monohydric alcohols such as methyl alcohol, butyl alcohol, isoamyl alcohol, myristyl alcohol, melissyl alcohol, allyl alcohol, propargyl alcohol, cinnamyl alcohol, furfuryl alcohol, etc.; polyhydric alcohols such as ethylene glycol, propylene glycol, 1,4-butanediol, 1,5-pentanediol, 1,10-decanediol, dipropylene glcyol, 3-methylpentanediol, polyethylene glycol, polypropylene glycol, polytetramethylene glycol, diethanolamine, dipropanolamine, triethanolamine, trimethylolpropane, glycerine, pentaerythritol, etc.; 2-4C alkyleneoxide adducts to the said hydroxyl group-having compounds; as well as 2-4C alkyleneoxide adducts to mono- or di-alkylphenols (where the alkyl moiety generally has 6 to 20 carbon atoms).

(4) Isocyanate group-containing compounds, for example, tolylene diisocyanate, diphenylmethane monoisocyanate, diphenylmethane diisocyanate, diphenylmethane triisocyanate, hexamethylene diisocyanate, lysine diisocyanate, dicyclohexylmethane monoisocyanate, dicyclohexylmethane diisocyanate, dicyclohexylmethane triisocyaante, isophorone diisocyanate, xylylene diisocyanate; reaction products of these isocyanate compounds and the above-mentioned (1) or (3); as well as 2-4C alkyleneoxide adducts of the said compounds.

(5) Reaction products of one or more compounds selected from the above-mentioned (1) or (2) or (3) and/or isocyanate compounds, and carboxylic acids (for example, acetic acid, propionic acid, hexylic acid, octylic acid, capric acid, undecylic acid, myristic acid, eicosanic acid, oleic acid, oxalic acid, succinic acid, adipic acid, azelaic acid, sebacic acid, phthalic acid, phthalic anhydride, terephthalic acid, etc.); as well as 2-4C alkylenoxide adducts thereto.

(6) Mercapto group-containing compounds, for example, methyl mercaptan, butyl mercaptan, lauryl mercaptan, benzyl mercaptan, thiophenol, ethyl mercaptopropionate, etc.

Among these various kinds of compounds (BB), preferred are those having oxyalkylene and/or ester group(s) in the molecule for the property as a dispersing agent. Especially preferred are those essentially having oxyalkylene group(s) in the molecule. Most preferred are alkyleneoxide adducts of the compounds (2).

Additionally, among these compounds (BB), those which have a similar molecular structure to the component (3) to be mentioned below (or a medium which does not substantially dissolve or which scarcely dissolves component (1)) and/or those which have a near solubility parameter between them are basically preferred as the component (1) may easily be dispersed therewith. For instance, where a medium of an alkylene glycol solvent is employed as component (3), the compound (BB) is desired to be an alkylene glycol compound or an ester thereof. On the other hand, where a medium of a phthalate solvent is employed as component (3), the compound (BB) is desired to be a phthalate compound.

However, even though both components of the compound (BB) and the component (1) do not have similar structures, they would also be preferred provided that the difference in the solubility parameter between them is small (generally, 2 or less), because of the same reason as mentioned above.

Where a compound (BB) has a low solubility to a lubricating oil for itself, it is preferred since dispersion of the component (1) with the compound may be easy. For instance, an aminoalcohol- propyleneoxide adduct having a molecular weight of about 2500 and a polyester to be obtained from phthalic acid and ethylene glycol and having a molecular weight of 1500, which are preferred examples of the compound (BB), do not dissolve transparently when incorporated into a lubricating oil in a proportion of 1% by weight.

The proportion of compound (AA) to compound (BB) varies, depending upon the compound (AA), compound (BB) or component (3) to be used, and therefore cannot be defined indiscriminately. Generally, however, the proportion of compound (AA)/compound (BB) is from 20/80 to 80/20 (by weight). Preferably, it is from 40/60 to 75/25, from the viewpoints of the easy dispersibility and the absence of turbidity when the improver of the invention is added to a lubricating oil.

Compound (2)(ii) is obtained by condensing additionally reacting one or more compounds (AA) and one or more compounds (BB). In this case, the linkage between the compound (AA) and the compound (BB) is one or more selected from thioester linkage, amide linkage, imide linkage and ester linkage.

The present invention also includes employment of adducts to be obtained by adding one or more alkyleneoxides to the carboxyl group(s)of a compound (AA), as the component (2)(ii). Additionally, compounds to be obtained by directly reacting one or more compounds (BB) having two or more functional groups in the molecule with the carboxyl group(s) or acid anhydride group(s) thereof of a compound (AA) also fall within the scope of the present invention; and compounds to be obtained by further adding alkyleneoxide(s) to the said compounds also fall within the same.

The component (3) is a medium which does not substantially dissolve or which scarcely dissolves olefinic polymers and, more precisely, has a solubility (20° C.) to olefinic polymers of, generally, 10% or less, preferably 5% or less. The solubility as referred to herein is meant to give a transparent homogeneous state when an olefinic polymer is singly dissolved in the medium. That is, it is not meant to give turbidity or phase-separation when the former is singly added to the latter.

As examples of media having such a solubility, there are mentioned esters, phosphates, alcohols having 6 or more carbon atoms and 2-4C alkyleneoxide adducts.

Single mineral oils which do not substantially dissolve olefinic polymers are also within the scope of the present invention. Examples thereof include modified mineral oils as formed by modifying mineral oils with oxygen and/or compounds containing oxygen and nitrogen or the like, which do not substantially dissolve or which scarcely dissolve olefinic polymers.

Examples of esters include ester compounds comprising carboxyl group-containing compounds such as monocarboxylic acids (e.g., acetic acid, propionic acid, hexylic acid, octylic acid, capric acid, undecylic acid, myristic acid, etc.), or dicarboxylic acids (e.g., succinic acid, adipic acid, azelaic acid, fumaric acid, maleic acid, phthalic acid, phthalic anhydride, isophthalic acid, terephthalic acid, etc.), or tricarboxylic acids (e.g., benzenetricarboxylic acid, etc.) or other polycarboxylic acids; and monohydric alcohols (e.g., methanol, butanol, hexyl alcohol, cyclohexyl alcohol, 2-ethylhexyl alcohol, octyl alcohol, decyl alcohol, myristyl alcohol, melissyl alcohol, etc.), or polyols (e.g. glycols such as ethylene glycol, triethylene glycol, tetraethylene glycol, propylene glycol, dipropylene glycol, hexamethylene glycol, decamethylene glycol, etc.; and glycerine, trimethylolpropane, pentaerythritol, etc.), or 2-4C alkyleneoxide adducts to the said monohydric alcohols or polyols (where the number of moles of alkyleneoxide(s) to be added is generally up to 50, preferably 1 to 35).

Among these various kinds of esters, preferred are diesters of dicarboxylic acids and monohydric alcohols, as well as di-, tri- or tetra-esters of polyols and monocarboxylic acids. Especially preferred are diester compounds comprising succinic acid, adipic acid, phthalic acid, phthalic anhydride, isophthalic anhydride or terephthalic anhydride and monohydric alcohols having 1 to 10 carbon atoms, as well as diester compounds comprising the above-mentioned glycols and monocarboxylic acids having 1 to 10 carbon atoms.

Preferred examples of phosphates are triesters with alcohols having 4 to 10 carbon atoms.

As examples of alcohols having 6 or more carbon atoms, there are mentioned monohydric alcohols such as 2-ethylhexyl alcohol, octyl alcohol, isooctyl alcohol, oxoalcohols having 6 to 10 carbon atoms, etc.; as well as polyhydric alcohols such as hexamethylene glycol, decamethylene glycol, pentaerythritol, etc.

Examples of alkyleneoxide adducts include compounds as prepared by adding alkyleneoxides having 2 to 4 carbon atoms to active hydrogen-containing compounds or heterocyclic compounds having mono- or poly-functional hydroxyl, amino, amide and/or carboxyl groups. As examples of carboxyl-having containing compounds, the above-mentioned mono- or polycarboxylic acids are referred to. Additionally, there are mentioned compounds having both carboxyl and hydroxyl group in the molecule, such as citric acid, gluconic acid, etc. As examples of amino group-containing compounds, the above-mentioned amino group-containing compounds are referred to. As examples of amide group-containing compounds, there are mentioned acetic acid amide, propionic acid amide, octylic acid amide, oleic acid amide, stearic acid amide, propionic acid monomethylamide, etc. As examples of active hydrogen-containing heterocyclic compounds, there are mentioned morpholine, etc.

The number of moles of alkyleneoxides to be added varies in accordance with the kinds of the active hydrogen-containing compounds to be added, but generally, it is 1 to 50, preferably 1 to 35. If the number of the moles to be added is too large, the solubility of the resulting adducts to mineral oils would lower causing haze or cloudiness in the finally prepared lubricating oil, which could be used with difficulty. Among various kinds of these alkyleneoxide adducts, preferred are compounds to be represented by a general formula $R—O—(AO)_n—H$ (where R means an alkyl or cycloalkyl group having 8 or less carbon atoms; n means an integer of 1 to 35; and A means an alkylene group having 2 to 3 carbon atoms).

Modified mineral oils are produced, for example, by the same method as that for introducing functional groups into olefinic polymers.

Among the said various kinds of components (3), preferred are dicarboxylic acid diesters and alkyleneoxide adducts.

Additionally, as the component (3) can be used these compounds containing mineral oils. In the case, the amount of the mineral oil to be added is not specifically limited. However, the larger the amount of mineral oil added, the higher the solubility to the component (1). Therefore, in order to maintain the solubility to component (1) to 10% or less, the amount of the mineral oil in the medium of component (3) is generally 85% or less.

Regarding the proportion of the respective components on the basis of the weight of the improver of the invention, the content of component (1) is generally 10 to 70%, preferably 20 to 60%; that of component (2) is generally 0.5 to 20%, preferably 1 to 10%; and that of component (3) is generally 90 to 25%, preferably 70 to 30%.

For preparing the improver of the invention, the component (2) is previously produced. The method of producing the component (2) would vary in accordance with the kinds of compounds (A) and (AA) and the kinds of compounds (B) and (BB) but it may be a conventional one. In producing the component (2), a solvent may be employed, as the case may be, for the purpose of lowering the viscosity of the reaction system. The solvent may be the component (3) of the invention, or may be selected from good solvents to olefinic polymers (for example, hexane, heptane, toluene, xylene or low boiling point synthetic hydrocarbons) which may be distilled off (under reduced pressure) or a mixture of such solvents.

The thus produced component (2) is blended with the component (3) and dissolved, and thereafter a solvent solution of the component (1) is added to the resulting solution under the condition of distilling off (under reduced pressure) the solvent used, with distilling off the solvent as used in dissolving the components (1) and (2), whereupon emulsification or dispersion of the olefinic polymer is effected. As a result, a stable dispersion may advantageously be obtained even though the amount of the component (2) used is small.

Needless to say, another method is also preferred where component (2) is blended with a solvent solution of component (1) and dissolved and component (1) is emulsified or dispersed with component (3) in the presence of component (2) in the same manner as above.

The solvent to be employed for dissolving the component (1) is not specifically limited. For instance, there are mentioned hexane, heptane, toluene, xylene, low boiling point synthetic hydrocarbons, etc. The indispensable condition for addition is that desolvation is possible during the addition procedure. The temperature is generally 50 to 200° C. If it is too high, olefinic polymers would decompose and the molecular chain of component (1) would extend and, as a result, could hardly be emulsified or dispersed. The time varies, depending upon the temperature and the pressure, and it is generally 2 to 10 hours. If the addition speed is too high, distillation of solvents would be unsatisfactory and, as a result, olefinic polymers could not be emulsified or dispersed well. In an extreme case, the whole would be gelled.

The improver of the present invention can contain a a pour point depressant for a lubricating oil, as a component (4). This is because in preparing a final engine oil or the like, the use of only components (1), (2) and (3) cannot display a sufficient pour point depressing function for mineral oils of certain kinds and, therefore, it is necessary to add a further pour point depressant to the improver of the invention. As typical examples of such a pour point depressant, there are mentioned poly-(meth)acrylates and chlorinated paraffin-naphthalene condensation products. These are widely generally sold in the market as commercial products. For example, there are commercial products of ACLUBE (by Sanyo Chemical) and PLEXOL (by Nippon Acryl) as a poly(-meth)acrylate reagent; and commercial products of LUBRAN (by Toho Chemical) as a chlorinated paraffin-naphthalane condensation product reagent. Preferred are poly-(meth)acrylates. The content of the component (4) is generally up to 30% by weight, preferably 5 to 20% by weight, to the weight of the improver.

The improver of the present invention may optionally contain further components (e.g., detergent or dispersant, antioxidant, friction modifier, etc.), if desired.

Generally, the component (4) is added after preparation of a dispersion from the components (1), (2) and (3).

The improver of the present invention is added to a lubricating oil generally in an amount of 1 to 20% by weight, whereupon it displays a viscosity index improving action and a thickening action and additionally a cleaning and dispersing action when the component (1) is a modified olefinic polymer and further a pour point depressing action when the improver contains the component (4).

Furthermore, the improver of the present invention can be used as a composition for fuel oil, grease, polymer/polyol, etc., if desired, in addition to a lubricating oil.

Next, the present invention will be explained in more detail by way of the following examples, which, however, are not intended to restrict the scope of the present invention. All "parts" and "%" are "parts by weight" and "% by weight" hereunder, unless otherwise specifically indicated.

EXAMPLE 1

320 parts of a 40% xylene solution of dihydroxyethylenepropylene copolymer (molecular weight; 8,000, propylene content; 50%, prepared by hydroxyethylating both terminals of the ethylene-propylene copolymer as produced by known living anionic polymerization with ethyleneoxide) and 460 parts of a 40% dibutyl phthalate solution of polyester obtained from 1,4-butanediol and phthalic anhydride (equivalent weight ratio; 41/40, molecular weight; 8,000) were fed into a four-mouthed reaction vessel fitted with a powerful stirrer, a temperature sensor, a condenser and a material charging inlet and stirred for one hour at 100° C. for homogenization. Afterwards, 4.3 parts of hexamethylene diisocyanate was added thereto and stirred for one hour at 120° C., and 0.02 part of dibutyl tin dilaurate was further added thereto and reacted until the NCO content became 0.05 or less (generally, for five hours) to obtain a 40% solvent solution of component (2)(i).

30.0 parts of the thus obtained 40% solvent solution of component (2)(i) and 339 parts of dibutyl phthalate were fed into the same reaction vessel (as fitted with a vacuum distilling apparatus in place of condenser) and stirred for one hour at 120° C. for dissolution. Next, xylene was distilled off from the resulting solution under the condition of 120° C. and 5 mm Hg, and 400 parts of a 40% xylene solution of ethylene-propylene copolymer of component (1) (molecular weight; 100,000, propylene content; 50%) kept at about 100° C. was gradually added to the solution over a period of 4 hours. During the addition, xylene was distilled off in accordance with the addition speed, whereby the component (1) was dispersed into the component (3). After all the solution of the component (1) was added, the whole was stirred for further 30 minutes to give a semi-translucent or milky-white dispersion having an ethylene-propylene copolymer content of 40.0%, which is the improver of the present invention. This had a viscosity of 903 cps/25° C.

EXAMPLE 2

400 parts of carboxy-ethylene-propylene copolymer (molecular weight; 9,000, propylene content; 50%, prepared by carboxylating the terminal of ethylene-propylene copolymer as produced by known living anionic polymerization with carbon dioxide) and 200 parts of polyester obtained from propylene glycol and adipic acid (equivalent weight ratio; 41/40, molecular weight; 9,000) were fed into a four-mouthed reaction vessel fitted with a powerful stirrer, a temperature sensor, a condenser and a material changing inlet and stirred for one hour at 200° C. for homogenization. Afterwards, 0.06 part of tetrabutyl titanate was added thereto and reacted under the condition of 220° C. and 5 mm Hg until the acid value became 0.05 or less (generally, for 8 hours) to obtain a component (2)(i).

13.0 parts of the thus obtained component (2)(i) and 300 parts of dioctyl adipate were fed into the same reaction vessel (as fitted with a vacuum distilling apparatus in place of condenser) and stirred for one hour at 120° C. for dissolution. Next, xylene was distilled off from the resulting solution under the condition of 120° C. and 5 mm Hg, and 675 parts of a 40% xylene solution of ethylene-propylene copolymer of component (1) (molecular weight; 100,000, propylene content; 50%) as kept at about 100° C. was gradually added to the solution over a period of 4 hours. During the addition, xylene was distilled off in accordance with the addition speed, whereby component (1) was dispersed into component (3). After all the solution of component (1) was added, the whole was stirred for 30 additional minutes to give a pale yellow and semitranslucent or milky-white dispersion having an ethylene-propylene copolymer content of 46.3%, which is an improver of the present invention. This had a viscosity of 870 cps/25° C.

EXAMPLE 3

400 parts of a 40% xylene solution of dicarboxyethylene-propylene copolymer (molecular weight; 15,000, propylene content; 50%, prepared by carboxylating both terminals of an ethylene-propylene copolymer as produced by known living anionic polymerization with carbon dioxide) and 44.8 parts of aminated polyether (molecular weight; 2,100, prepared by ketiminating monoethanolamine with methyl isobutyl ketone followed by adding 34 mols of propyleneoxide to the hydroxyl groups of the ketiminated product) were fed into a four-mouthed reaction vessel fitted with a powerful stirrer, a temperature sensor, a condenser and a material charging inlet and reacted under reflux (at 138 to 143° C.) while removing the formed water out of the reaction system, until the acid value became 0.05 or less (generally, for 5 hours), to obtain a 45.8% solution of component (2)(i).

18.3 parts of the thus obtained 45.8% solution of component (2)(i) and 300 parts of n-butanol-propyleneoxide (3 mols) adduct of component (3) were fed into the same reaction vessel (as fitted with a vacuum distilling apparatus in place of condenser) and stirred for one hour at 120° C. for dissolution. Next, xylene was distilled off under the condition of 120° C. and 5 mm Hg, and 600 parts of a 40% xylene solution of ethylene-propylene copolymer of component (1) (molecular weight; 100,000, propylene content; 50%) as kept at about 100° C. was gradually added to the solution over a period of 4 hours. During the addition, xylene was distilled off in accordance with the addition speed, whereby component (1) was dispersed into component (3). After all the solution of component (1) was added, the whole was stirred for 30 additional minutes to give a semitranslucent or milky-white dispersion having an ethylene-propylene content of 43.8%, which is an improver of the present invention. This had a viscosity of 942 cps/25° C.

EXAMPLE 4

320 parts of a 40% xylene solution of dihydroxyethylenepropylene copolymer (molecular weight; 4,000, propylene content; 50%, prepared by hydroxylating both terminals of an ethylene-propylene copolymer as produced by known living anionic polymerization with oxygen) and 7.2 parts of hexamethylene diisocyanate were added to a four-mouthed reaction vessel fitted with a powerful stirrer, a temperature sensor, a condenser and a material charging inlet and reacted for one hour at 100° C. Next, 0.01 part of dibutyl tin dilaurate was added thereto and further reacted until the NCO content became 0.7 or less (generally, for 5 hours) to obtain a prepolymer solution. To this was added 106.7 parts of polypropylene glycol (molecular weight; 5,000) and reacted for one hour at 100° C., and 0.02 part of dibutyl tin dilaurate was added thereto and further reacted at 120° C. until the NCO content became 0.05 or less (generally, for 5 hours) to obtain a 55.8% solvent solution of component (2)(i).

15.1 parts of the thus obtained 55.8% solvent solution of component (2)(i) and 231.6 parts of tetraethylene glycol-hexylic acid diester of component (3) were fed into the same reaction vessel (as fitted with a vacuum distilling apparatus in place of condenser) and stirred for one hour at 120° C. for dissolution. Next, xylene was distilled off under the condition of 120° C. and 5 mmHg, and 600 parts of a 40% xylene solution of N-vinylimidazole-modified ethylene-propylene copolymer of component (1) (as obtained by reacting ethylene-propylene copolymer having a molecular weight of 100,000 and a propylene content of 50% with 20 molar equivalents of N-vinylimidazole in the presence of benzoyl peroxide in xylene) as kept at about 100° C. was gradually added to the solution over a period of 4 hours. During the addition, xylene was distilled off in accordance with the addition speed, whereby component (1) was dispersed into component (3). After all the solution of component (1) was added, the whole was stirred for 30 additional minutes to give a pale yellow and semitranslucent or milky-white dispersion having an ethylenepropylene copolymer content of 40.0%, which is an improver of the present invention. This has a viscosity of 1050 cps/25° C.

EXAMPLE 5

12 parts of polymethacrylate type pour point depressant (ACLUBE 138) was incorporated into 100 parts of the improver of the invention or the semitranslucent milky-white dispersion having an ethylene-propylene content of 40.0% as obtained in Example 1, to obtain a pale yellow and semitranslucent or milky-white dispersion which is an improver of the invention. This had a viscosity of 1005 cps/25° C.

EXAMPLE 6

250 parts of a 40% xylene solution of ethylene-propylene copolymer-maleic anhydride adduct (molecular weight; 100,000, propylene content; 50%, maleic anhydride content; 2%) and 41.4 parts of aminated polyether (molecular weight; 2,030, this was prepared by ketiminating monoethanolamine with methyl isobutyl ketone followed by adding 34 mols of propyleneoxide to the hydroxyl groups of the ketiminated product and hydrolyzing the resulting product) were fed into a four-mouthed reaction vessel fitted with a powerful stirrer, a temperature sensor, a condenser and a material charging inlet and reacted under reflux (at 138 to 150° C.) while removing the formed water out of the reaction system until the acid value became 0.04 or less (generally, for 2 hours), to give a 48.5% solution of component (2)(ii).

24.7 parts of the thus obtained 48.2% solution of component (2)(ii) and 228 parts of n-butanol-propyleneoxide (4 mols) adduct of component (3) were fed into the same reaction vessel (as fitted with a vacuum distilling apparatus in place of condenser) and dissolved, and thereafter xylene was distilled off under the condition of 120° C. and 5 mmHg. Next, 600 parts of a 40% xylene solution of N-vinylimidazole-modified ethylenepropylene copolymer of component (1) (as obtained by reacting ethylene-propylene copolymer having a molecular weight of 100,000 and a propylene content of 50% with 20 molar equivalents of N-vinylimidazole in the presence of benzoyl peroxide in xylene) as kept at about 100° C. was gradually added to the solution over a period of 4 hours. During the addition, xylene was distilled off in accordance with the addition speed, whereby component (i) was dispersed into component (3). After all the solution of component (1) was added, the whole was stirred for 30 additional minutes to give a semitranslucent or milky-white dispersion having an ethylenepropylene copolymer content of 50.0%, which is an improver of the invention. This had a viscosity of 1045 cps/25° C.

EXAMPLE 7

250 parts of a 40% xylene solution of ethylene-propylene copolymer-maleic anhydride adduct (molecular weight; 120,000, propylene content; 50%, maleic anhydride content; 2%) and 41.4 parts of ketiminated polyether (molecular weight; 2,030, prepared by ketiminating monoethanolamine with methyl isobutyl ketone followed by adding 34 mols of propyleneoxide to the hydroxyl groups of the ketiminated product) were fed into a four-mouthed reaction vessel fitted with a powerful stirrer, a temperature sensor, a condenser and a material charging inlet and reacted under reflux (at 138 to 150° C.) while removing the formed water out of the reaction system until the acid value became 0.04 or less (generally, for 2 hours), to obtain a 48.5% solution of component (2)(ii).

24.7 parts of the thus obtained 48.5% solution of component (2)(ii) and 228 parts of dibutyl phthalate of component (3) were fed into the same reaction vessel (as fitted with a vacuum distilling apparatus in place of condenser) and dissolved. Next, xylene was distilled off under the condition of 120° C. and 5 mmHg, and 600 parts of a 40% xylene solution of N-vinylpyrrolidone-modified ethylene-propylene copolymer of component (1) (as prepared by reacting ethylene-propylene copolymer having a molecular weight of 100,000 and a propylene content of 50% with 15 molar equivalents of N-vinylpyrrolidone in the presence of benzoyl peroxide in xylene) as kept at about 100° C was gradually added to the resulting solution over a period of 4 hours. During the addition, xylene was distilled off in accordance with the addition speed, whereby component (1) was dispersed into component (3). After all the solution of component (1) was added, the whole was stirred for 30 additional minutes to give a semitranslucent or milky-white dispersion having an ethylene-propylene content of 50.0%, which is an improver of the present invention. This had a viscosity of 876 cps/25° C.

EXAMPLE 8

250 parts of a 40% xylene solution of ethylene-propylene copolymer-maleic anhydride adduct (molecular weight; 100,000, propylene content; 50%, maleic anhydride acid content;2%) and 60.4 parts of methyl alcohol-propyleneoxide adduct (molecular weight; 1,480) were fed into a four-mouthed reaction vessel fitted with a powerful stirrer, a temperature sensor, a condenser and a material charging inlet and homogenized. Next, 0.02 part of tetrabutyl titanate was added thereto and reacted under reflux (at 138° to 150° C.) while removing the formed water out of the reaction system until the acid value became 0.04 or less (generally, for 6 hours) to obtain a 51.7% solution of component (2)(ii).

249 parts of dioctyl phthalate of component (3) was fed into the same reaction vessel (as fitted with a vacuum distilling apparatus in place of condenser), and a mixture comprising 540 parts of a 40% xylene solution of oxidized and degraded product of ethylene-propylene copolymer of component (1) (molecular weight; degraded from 250,000 to 120,000, propylene content; 50%) as kept at about 100° C. and 29.3 parts of the previously prepared 51.7% solvent solution of component (2)(ii) was gradually added thereto under the condition of 120° C. and 5 mmHg, over a period of 6 hours. During the addition, xylene was distilled off in accordance with the addition speed, whereby component (1) was dispersed into component (3). After all the solution of component (1) was added, the whole was stirred for 30 additional minutes to give a pale yellow and semitranslucent or milky-white dispersion having an ethylene-propylene copolymer content of 45.0%, which is an improver of the present invention. This had a viscosity of 945 cps/25° C.

EXAMPLE 9

250 parts of a 40% xylene solution of ethylene-propylene copolymer-maleic anhydride adduct (molecular weight; 100,000, propylene content; 50%, maleic anhydride content; 3%) and 69.2 parts of an equivalent reaction product (molecular weight: 1130) of morpholine-ethyleneoxide adduct (molecular weight; 970) and hexamethylene diisocyanate were fed into a four-mouthed reaction vessel fitted with a powerful stirrer, a temperature sensor, a condenser and a material charging inlet and reacted at 90° to 120° C. until the acid value became 0.06 or less (generally, for 5 hours), to obtain a 52.7% solution of component (2)(ii).

31.9 parts of the thus obtained 52.7% solution of component (2)(ii) and a mixture comprising 200.9 parts of n-butanol-ethyleneoxide (4 mols) adduct of component (3) and 22.3 parts of mineral oil were fed into the same reaction vessel (as fitted with a vacuum distilling apparatus in place of condenser) and dissolved. Next, xylene was distilled off under the condition of 120° C. and 5 mmHg, and 600 parts of a 40% xylene solution of dimethylaminoethyl methacrylate-modified ethylene-propylene copolymer of component (1) (as prepared by reacting ethylene-propylene copolymer having a molecular weight of 120,000 and a propylene content of 50% with 15 molar equivalents of dimethylaminoethyl methacrylate in the presence of benzoyl peroxide in xylene) as kept at about 100° C. was gradually added to the resulting solution over a period of 4 hours. During the addition, xylene was distilled off in accordance with the addition speed, whereby the component (1) was dispersed into component (3). After all the solution of the component (1) was added, the whole was stirred for 30 additional minutes to give a semitranslucent or milky-white dispersion having an ethylene-propylene content of 50.0%, which is an improver of the present invention. This had a viscosity of 1233 cps/25° C.

EXAMPLE 10

250 parts of a 40% xylene solution of ethylene-propylene copolymer-maleic anhydride adduct (molecular weight; 100,000, propylene content; 50%, maleic anhydride content; 1.5%) and 55.1 parts of polyester (molecular weight; 1,800) as obtained from polytetramethylene glycol (molecular weight; 510) and phthalic anhydride (equivalent weight ratio; 3/2) were fed into a four-mouthed reaction vessel fitted with a powerful stirrer, a temperature sensor, a condenser and a material charging inlet and homogenized. Next, 0.02 part of tetrabutyl titanate was added thereto and reacted under reflux (at 138° to 150° C.) while removing the formed water out of the reaction system until the acid value became 0.03 or less (generally, for 6 hours) to give a 50.8% solution of component (2)(ii).

47.2 parts of the thus obtained 50.8% solution of component (2)(ii) and 216 parts of tributyl phosphate of component (3) were fed into the same reaction vessel (as fitted with a vacuum distilling apparatus in place of condenser) and dissolved. Next, xylene was distilled off under the condition of 120° C. and 5 mmHg, and 600 parts of a 40% xylene solution of dimethylaminoethyl methacrylate-modified ethylene-propylene copolymer of component (1) (as prepared by reacting ethylene-propylene copolymer having a molecular weight of 120,000 and a propylene content of 50% with 15 molar equivalents of dimethylaminoethyl methacrylate in the presence of benzoyl peroxide in xylene) as kept at about 100° C. was gradually added to the resulting solution over a period of 5 hours. During the addition, xylene was distilled off in accordance with the addition speed, whereby the component (1) was dispersed into component (3). After all the solution of component (1) was added, the whole was stirred for further 30 minutes to give a semitranslucent or milky-white dispersion having an ethylene-propylene content of 50.0%, which is an improver of the present invention. This had a viscosity of 903 cps/25° C.

EXAMPLE 11

250 parts of a 40% xylene solution of ethylene-propylene copolymer-maleic anhydride adduct (molecular weight; 100,000, propylene content; 50%, maleic anhydride content; 2%) and 51.4 parts of polyester (molecular weight; 1,260) as obtained from triethylene glycol and adipic acid (equivalent weight ratio; 5/4) were fed into a four-mounted vessel fitted with a powerful stirrer, a temperature sensor, a condenser and a material charging inlet and homogenized. Next, 0.02 part of tetrabutyl titanate was added thereto and reacted under reflux (at 138 to 150° C.) while removing the formed water out of the reaction system until the acid value became became 0.03 or less (generally, for 6 hours) to give a 50.1% solution of component (2)(ii).

33.1 parts of the thus obtained 50.1% solution of component (2)(ii) and 223.2 parts of triethylene glycol dibutyrate of component (3) were fed into the same reaction vessel (as fitted with a vacuum distillating apparatus in place of condenser) and dissolved. Next, xylene was distilled off under the condition of 120° C. and 5 mmHg, and 600 parts of a 40% xylene solution of diethylaminoethyl methacrylate-modified ethylene-propylene copolymer of component (1) (as prepared by reacting ethylene-propylene copolymer having a molecular weight of 120,000 and a propylene content of 50% with 15 molar equivalents of dimethylaminoethyl methacrylate in the presence of benzoyl peroxide in xylene) as kept at about 100° C. was gradually added to the resulting solution over a period of 5 hours. During the addition, xylene was distilled off in accordance with the addition speed, whereby component (1) was dispersed into the component (3). After all the solution of component (1) was added, the whole was stirred for 30 additional minutes to give a semitranslucent or milky-white dispersion having an ethylene-propylene copolymer content of 50.0%, which is an improver of the present invention. This had a viscosity of 1230 cps/25° C.

EXAMPLE 12

250 parts of a 40% xylene solution of ethylene-propylene copolymer-maleic anhydride adduct (molecular weight; 100,000, propylene content; 50%, maleic anhydride content; 2%) and 39.6 parts of polyester (molecular weight; 970) as obtained from 1,8-octanediol and phthalic anhydride (equivalent weight ratio; 4/3) were fed into a four-mouthed reaction vessel fitted with a powerful stirrer, a temperature sensor, a condenser and a material charging inlet and homogenized. Next, 0.02 part of tetrabutyl titanate was added thereto and reacted under reflux (at 138° to 150° C.) while removing the formed water out of the reaction system until the acid value became 0.03 or less (generally, 6 hours) to give a 48.1% solution of component (2)(ii).

51.9 parts of the thus obtained 48.1% solution of compound (2)(ii) and 263 parts of dioctyl phthalate of compound (3) were fed into the same reaction vessel (as fitted with a vacuum distilling apparatus in place of condenser) and dissolved. Next, xylene was distilled off under the condition of 120° C. and 5 mmHg, and 480 parts of a 40% xylene solution of dimethylaminoethyl methacrylate-modified ethylene-propylene copolymer of component (1) (as prepared by reacting ethylene-propylene copolymer having a molecular weight of 120,000 and a propylene content of 50% with 15 molar equivalents of dimethylaminoethyl methacrylate in the presence of benzoyl peroxide in xylene) as kept at about 100° C. was gradually added to the resulting solution over a period of 5 hours. During the addition, xylene was distilled off in accordance with the addition speed, whereby component (1) was dispersed into component (3). After all the solution of the component (1) was added, the whole was stirred for 30 additional minutes to give a semitranslucent or milky-white dispersion having an ethylene-propylene copolymer content of 40.0%, which is an improver of the present invention. This had a viscosity of 865 cps/25° C.

EXAMPLE 13

250 parts of a 40% xylene solution of ethylenepropylene copolymer-maleic anhydride adduct (molecular weight; 100,000, propylene content; 50%, maleic anhydride; 3%) and 64.9 parts of a reaction product (molecular weight; 1,060) of polypropylene glycol (molecular weight; 840) and isophorone diisocyanate were fed into a four-mouthed reaction vessel fitted with a powerful stirrer, a temperature sensor, a condenser and a material charging inlet and reacted at 90 to 120° C. until the acid value became 0.06 or less (generally, for 6 hours) to give a 52.4% solution of component (2)(ii).

42.5 parts of the thus obtained 52.4% solution of component (2)(ii) and 237.3 parts of hexyl alcohol-propyleneoxide (8 mols) adduct were fed into the same reaction vessel (as fitted with a vacuum distilling apparatus in place of condenser) and dissolved. Next, xylene was distilled off under the condition of 120° C and 5 mmHg, and 540 parts of a 40% xylene solution of ethylene-propylene copolymer of component (1) (molecular weight; 100,000, propylene content; 50%) as kept at about 100° C. was gradually added to the resulting solution over a period of 5 hours. During the addition, xylene was distilled off in accordance with the addition speed, whereby component (1) was dispersed into component (3). After all the solution of component (1) was added, the whole was stirred for 30 additional minutes to give a semitranslucent or milky-white dispersion having an ethylene-propylene copolymer content of 45.0%, which is an improver of the present invention. This had a viscosity of 1302 cps/25° C.

EXAMPLE 14

250 parts of a 40% xylene solution of ethylene-propylene copolymer-fumaric acid adduct (molecular weight; 100,000, propylene content; 60%, fumaric acid content; 3%) and 52.0 parts of ketiminated polyether (molecular weight; 1700, prepared by ketiminating monopropanolamine with methyl isobutyl ketone followed by adding 35 mols of ethyleneoxide to the hydroxyl groups of the ketiminated product) were fed into a four-mouthed reaction vessel fitted with a powerful stirrer, a temperature sensor, a condenser and a material charging inlet and reacted at 130° to 140° C. while removing the formed methyl isobutyl ketone out of the reaction system, until the acid value became 0.06 or less (generally, for 2 hours) to give a 49.8% solution of component (2)(ii).

200.2 parts of dibutyl phthalate of component (3) was fed into the same reaction vessel (as fitted with a vacuum distilling apparatus in place of condenser), and a mixture comprising 660 parts of a 40% xylene solution of ethylene-propylene copolymer of component (1) (molecular weight; 100,000, propylene content; 50%) and 31.8 parts of the previously prepared 49.8% solvent solution of component (2)(ii), the mixture being kept at about 100° C., was gradually added thereto over a period of 6 hours under the condition of 120° C. and 5 mmHg. During the addition, xylene was distilled off in accordance with the addition speed, whereby component (1) was dispersed into component (3). After all the solution of component (1) was added, the whole was stirred for 30 additional minutes to give a semitranslucent or milky-white dispersion having an ethylene-propylene copolymer content of 55.0%, which is an improver of the present invention. This had a viscosity of 1183 cps/25° C.

EXAMPLE 15

250 parts of a 40% xylene solution of ethylene-propylene copolymer-maleic anhydride adduct (molecular weight; 100,000, propylene content; 50%, maleic anhydride content; 2%) and 51.0 parts of morpholine-propyleneoxide adduct (molecular weight 1,250) were fed into a four-mouthed reaction vessel fitted with a powerful stirrer, a temperature sensor, a condenser and a material changing inlet and homogenized. Next, 0.02 part of tetrabutyl titanate was added thereto and reacted under reflux (at 138 to 150° C.) while removing the formed water out of the reaction system until the acid value became 0.04 or less (generally, for 6 hours) at 90 to 120° C. to give a 50.0% solution of component (2)(ii).

38.4 parts of the thus obtained 50.0% solution of component (2)(ii) and 220.8 parts of n-butanol-propyleneoxide (4 mols) adduct of component (3) were fed into the same reaction vessel (as fitted with a vacuum distilling apparatus in place of condenser) and dissolved. Next, xylene was distilled off under the condition of 120° C. and 5 mmHg, and 600 parts of a 40% xylene solution of ethylene-propylene copolymer of component (1) (molecular weight; 100,000, propylene content; 50%) as kept at about 100° C. was gradually added thereto over a period of 4 hours. During the addition, xylene was distilled off in accordance with the addition speed, whereby component (1) was dispersed into component (3). After all the solution of component (1) was added, the whole was stirred for 30 additional minutes to give a semitranslucent or milky-white dispersion having an ethylene-propylene content of 50.0%, which is an improver of the present invention. This had a viscosity of 1158 cps/25° C.

EXAMPLE 16

12 parts of polymethacrylate type pour point depressant (ACLUBE 138, manufactured by Sanyo Chemical) was incorporated into 100 parts of the semitranslucent or milky-white dispersion having an ethylene-propylene copolymer content of 50.0% as obtained in Example 6, to obtain a pale yellow and semitranslucent or milky-white dispersion which is an improver of the present invention. This had a viscosity of 1205 cps/25° C.

The improver of the present invention has various advantageous effects as mentioned below. In accordance with the prior art techniques, excess (meth)acrylates are necessary for producing dispersing agents, or a large amount (for example 12% or more) of a dispersing agent must always be used, except when using styrene-isoprene copolymer as an emulsifier. That is, the prior art techniques have various troublesome problems and, therefore, are not considered to be efficient. Additionally, incorporation of such an emulsifier of styrene-isoprene block copolymer would cause haze or cloudiness when the resulting composition is dissolved in a mineral oil, and such haze or cloudiness would often cause trouble in practical use. As opposed to such defective prior art techniques, the amount of the dispersing agent to be incorporated in the improver of the present invention may be small (for example, 5% or less) to sufficiently display the effect. Therefore, in accordance with the present invention, a high-concentration non-aqueous dispersion of a low-viscosity olefinic polymer may be obtained efficiently.

Regarding the prior art method of preparing such a dispersion, a granular olefinic copolymer is emulsified in a poor solvent of a dispersing agent by the use of a particular high shearing force stirrer. In accordance with this method, however, employment of such a particular stirrer is indispensable. Additionally, since a granular olefinic copolymer is to be used, the propylene content in the olefinic copolymer is inevitably to be about 30% or less or about 70% or more (this is because if the content is 40 to 60%, the olefinic copolymer itself would be too soft and therefore could hardly be shaped into granules). Moreover, when the olefinic polymer is degraded or modified in a solvent solution prior to emulsification, the resulting solvent solution containing the degraded or modified olefinic polymer could not be used directly. That is, the prior art method has various troublesome problems. As opposed to this, the method of the present invention may be carried out by the use of a general stirring device and the olefinic polymer to be used does not need to be granulated. Therefore, the olefinic polymer to be used in the present invention is not specifically limited with respect to the propylene content. Additionally, where the olefinic polymer to be used is degraded or modified in a solvent solution prior to emulsification, the resulting solvent solution of the degraded or modified olefinic polymer may be used directly Accordingly, the present invention has various advantageous merits in the said points.

While the invention has been described in detail and with reference to specific embodiments thereof, it will be apparent to one skilled in the art that various changes and modifications can be made therein without departing from the spirit and scope thereof.

What is claimed is:

1. A viscosity index improver for nonpolar lubricants which comprises:

(1) 10–70% by weight, based on the viscosity index improver, of an ethylenically unsaturated hydrocarbon polymer or a modified ethylenically unsaturated hydrocarbon polymer that contains up to about 10 weight percent of at least one element selected from the group consisting of N, O and S having a molecular weight of 1,000 to 500,000;

(2) 0.5–20% by weight, based on the viscosity index improver, of a compound (i) or (ii), wherein (i) is an oligomeric or a polymeric oil soluble compound having at least one segment comprising A and B and having at least one linkage group between A and B, said linkage group being selected from the group consisting of ester linkage, thioester linkage, urethane linkage, urea linkage, amide linkage, imide linkage, and ether linkage wherein A is a residue of a hydrocarbon compound having at least one functional group, said functional group being selected from the group consisting of hydroxyl group, carboxyl group, carbonyl group, amino group, and dithiocarboxyl group, and having a molecular weight of 1,000 to 500,000 and B is a residue of a compound having at least one functional group, said functional group being selected from the group consisting of carboxyl group, hydroxyl group, isocyanate group, amino group, and ketimine group, said oligomeric or polymeric compound being substantially free of functional group(s) after linkage of A and B, and (ii) is a reaction product of AA and BB wherein AA is an ethylenically unsaturated hydrocarbon polymer having a weight average molecular weight of 500 to 500,000 and to which are added ethylenic unsaturated dicarboxylic acid(s) and BB is a compound having at least one functional group, said functional group being selected from the group consisting of mercapto group, amino group, ketimine group, hydroxy group and isocyanate group, said AA and BB being bonded through at least one linkage, said linkage being selected from the group consisting of thioester linkage, amide linkage, imide linkage and ester linkage; and (3) 25–90% by weight, based on the viscosity index improver, of an organic liquid medium to which the solubility (20° C.) of said ethylenically unsaturated hydrocarbon polymer or modified ethylenically unsaturated hydrocarbon polymer is 10% or less.

2. An improver according to claim 1, wherein component (3) is a medium, to which the solubility of said ethylenically unsaturated hydrocarbon polymer is not higher than 5% by weight.

3. An improver according to claim 1, wherein component (3) is at least one medium selected from the group consisting of phosphates, esters, alcohols having 6 or more carbon atoms and alkyleneoxide-adducts of said phosphates, esters and alcohols.

4. An improver according to any one of claims 1 to 3, wherein the component (3) is at least one medium selected from the group consisting of dicarboxylic acid diesters and said alkyleneoxide adducts.

5. An improver according to any one of claims 1 to 3, wherein component (3) is a medium containing a mineral oil or a mineral oil modified with oxygen and/or a compound containing oxygen and nitrogen.

6. As improver according to any one of claims 1 to 3, wherein A or AA in component (2) is a polymer having a molecular structure similar to component (1).

7. An improver according to any one of claims 1 to 3, wherein component (1) is an ethylene-propylene copolymer.

8. An improver according to any one of claims 1 to 3, wherein component (1) is a basic nitrogen-containing ethylenically unsaturated hydrocarbon polymer.

9. An improver according to any one of claims 1 to 3, wherein the linkage between A and B in component (2) (i) is an ester linkage.

10. An improver according to any one of claims 1 to 3, wherein the linkage between A and B in component (2) (i) is an ester linkage containing a (poly)alkylene glycol moiety.

11. An improver according to any one of claims 1 to 3, wherein the weight ratio of A and B in component (2) (i) is from 20/80 to 90/10.

12. An improver according to claim 1, wherein BB in the component (2) (ii) is a compound containing said at least one functional group, and having an oxyalkylene group and/or an ester group in the molecule.

13. An improver according to claim 1 or 12, wherein BB in the component (2) (ii) is a compound containing said at least one functional group, and having an oxyalkylene group in the molecule.

14. An improver according to claim 1 or 12, wherein BB in the component (2) (ii) is a 2-4C alkyleneoxide adduct of a compound having mercapto group, amino group, ketimine group or hydroxyl group.

15. An improver according to claim 1 or 12, wherein the weight ratio of AA and BB in the component (2) (ii) is from 20/80 to 80/20.

16. An improver according to any one of claims 1 to 3 or 12, wherein component (3) contains 85% or less by weight of a mineral oil, based on said medium.

17. An improver according to any one of claims 1 to 3 or 12, which further contains a pour point depressant for a lubricating oil.

18. An improver according to claim 17, which contains said pour point depressant in an amount of up to 30% by weight of improver.

19. An improver according to claim 1, which contains component (1) in an amount of 20 to 60% by weight of the improver.

20. A method for preparing a viscosity index improver as set forth in claim 1, wherein a solvent solution of component (1) is, blended with a solution comprising component (2) and component (3) while distilling off the solvent used in dissolving components (1) and (2) whereby component (1) is emulsified or dispersed in component (3) in the presence of component (2).

21. A method for preparing a viscosity index improver as set forth in claim 1, wherein a solvent solution comprising component (1) and component (2) is blended with component (3) while distilling off the solvent used whereby component (1) is emulsified or dispersed in component (3) in the presence of component (2).

22. An improver according to claim 1, wherein component (1) has a molecular weight of 10,000 to 500,00.

23. An improver according to claim 1, wherein said hydrocarbon compound having the residue A and said compound having the residue B have an average of 1 to 3.5 functional group(s) per molecule.

24. The improver according to claim 5, wherein said modified mineral oil is selected from the group consisting of an oxidized mineral oil and a mineral oil grafted with an unsaturated compound having an oxygen atom and a nitrogen atom.

25. The method according to claim 20, wherein a pour point depressant is added to the resulting emulsion or dispersion.

26. The method according to claim 21, wherein a pour point depressant is added to the resulting emulsion or dispersion.

* * * * *